US007895692B1

(12) United States Patent
Najafi pour

(10) Patent No.: US 7,895,692 B1
(45) Date of Patent: Mar. 1, 2011

(54) PORTABLE COLLAPSIBLE BABY MATTRESS APPARATUS

(76) Inventor: Simin Najafi pour, Castle Hill (AU)

( * ) Notice: Subject to any disclaimer, the term of this patent is extended or adjusted under 35 U.S.C. 154(b) by 0 days.

(21) Appl. No.: 12/817,445

(22) Filed: Jun. 17, 2010

(51) Int. Cl.
*A47D 7/00* (2006.01)

(52) U.S. Cl. ..... 5/694; 5/713; 5/722; 5/93.1; 5/655

(58) Field of Classification Search ..... 5/655, 694, 5/713, 722, 93.1, 102, 603
See application file for complete search history.

(56) References Cited

U.S. PATENT DOCUMENTS 4,670,923 A 6/1987 Gabriel et al.
5,339,470 A 8/1994 Shamie
6,026,525 A * 2/2000 Davis ..... 5/99.1
6,686,711 B2 * 2/2004 Rose et al. ..... 318/16
6,850,288 B2 * 2/2005 Kurokawa ..... 348/836
2007/0074348 A1 4/2007 Carlton
2008/0236452 A1 * 10/2008 Pratt et al. ..... 108/13
2009/0064415 A1 * 3/2009 Payne et al. ..... 5/620
2009/0178202 A1 7/2009 Kovalyak

* cited by examiner

*Primary Examiner* — Fredrick Conley
(74) *Attorney, Agent, or Firm* — Crossley Patent Law; Mark A. Crossley

(57) ABSTRACT

The portable collapsible baby mattress apparatus provides multiple caregiving functions for an infant. The inflatable mattresses pads are selectively fastened to provide a horizontal mattress assembly, and selectively disassembled for portability and compact state. Functions include simulation of a caregivers heartbeat and breathing, entertainment and education for an infant via the view screen and speaker/mic, infant monitoring with alarm, and height and swivel adjustment of the view screen.

11 Claims, 4 Drawing Sheets

PORTABLE COLLAPSIBLE BABY MATTRESS APPARATUS

BACKGROUND OF THE INVENTION

Caring for a baby involves a great deal of time with the baby in a crib, whether the child is asleep or awake. Various devices have provided entertainment for babies, while in the crib, and have also provided features that mimic a caregiver, such as simulated breathing and heartbeat devices. The present apparatus provides a combination of features not heretofore provided for in-crib baby care.

FIELD OF THE INVENTION

The portable collapsible baby mattress apparatus relates to baby care devices and more especially to a multi-functional baby care apparatus that can fit within or without a crib and provide features not heretofore provided.

SUMMARY OF THE INVENTION

The general purpose of the portable collapsible baby mattress apparatus, described subsequently in greater detail, is to provide a portable collapsible baby mattress apparatus which has many novel features that result in an improved portable collapsible baby mattress apparatus which is not anticipated, rendered obvious, suggested, or even implied by prior art, either alone or in combination thereof.

To attain this, the portable collapsible baby mattress apparatus provides a multitude of features that not only comfort, educate, and entertain a baby but also protect the baby. The apparatus fits into virtually any crib, whether the preferably inflatable pads are used in total or only part. The pads are ideally offered in inflatable design but may also be provided as cushions. Pads may be joined by zippers, hook and loop, or other appropriate devices. Inflatable pads may contain at least two or more air tubes for inflation. In the ideal embodiment, the apparatus may feature two identical larger pads along with two smaller pads. The computer case may be attached to either of the two smaller pads, in the ideal embodiment, along the pad length, with the same length as the pad and a minimal width of only about 5 cm. Other embodiments may provide identical pads with optional computer case attachment as chosen. The smaller pads, with computer case on one and inflatable rib on the other then have the same width dimension as the two larger pads. One selected pad may be selectively inflated to elevate an infant's head for safety and also to simulate rise and fall of a caregiver's breathing and rocking.

The controls disposed upwardly within the computer case may provide for controlling the various functions of the apparatus. The controls may be in communication with the inflation fan, the battery pack, the alarm, the view screen, the speaker/mic, the heartbeat nodule, the vent with fan, and the strap monitor. The inflation fan, via the controls, inflates the air tubes within the pads to a selected rigidity level. The alarm can be set to notify a caregiver if any abnormality in a baby's pulse or breathing is detected by the strap monitor, which may be affixed around a limb of the baby. The controls allow a caregiver to dictate the optionally detachable, foldable view screen content and speaker/mic output with choices contained within the controls, choices such as videos for entertainment and education. The speaker/mic allows communication with an infant from afar. The heartbeat nodule can be set by the controls to simulate a caregiver's heartbeat, thereby offering the baby comfort. The vent with fan can be set to blow warm air to the baby in simulation of a caregiver's breath.

The apparatus multitude of functions provide for institutional use as well as home use in monitoring, caring for, educating, and entertaining a baby, in a crib or elsewhere. The apparatus is provided with pads of various sizes, although the preferred embodiment provides critically dimensioned pads that best afford fit to various cribs, whether used in total horizontal plane, or with only part of the pads used. The most critical dimensioned pads are also designed for best collapse and portability. The computer may also be used as a multimedia play device.

Thus has been broadly outlined the more important features of the improved portable collapsible baby mattress apparatus so that the detailed description thereof that follows may be better understood and in order that the present contribution to the art may be better appreciated.

An object of the portable collapsible baby mattress apparatus is to provide exceptional care features for a baby in a crib.

Another object of the portable collapsible baby mattress apparatus is to provide exceptional care features for a baby outside of a crib.

A further object of the portable collapsible baby mattress apparatus is to be collapsible.

An added object of the portable collapsible baby mattress apparatus is to capable of substantial disassembly.

And, an object of the portable collapsible baby mattress apparatus is to be capable of substantial inflation and deflation.

Yet another object of the portable collapsible baby mattress apparatus is to be highly portable.

Still another object of the portable collapsible baby mattress apparatus is to mimic a caregiver's breathing.

And, an object of the portable collapsible baby mattress apparatus is to mimic a caregiver's heartbeat.

Another object of the portable collapsible baby mattress apparatus is to monitor a baby's vital signs.

Still a further object of the portable collapsible baby mattress apparatus is to entertain a baby.

A further object of the portable collapsible baby mattress apparatus is to educate a baby.

And, another object of the portable collapsible baby mattress apparatus is to provide a selectively positionable view screen for the baby's entertainment and education.

These together with additional objects, features and advantages of the improved portable collapsible baby mattress apparatus will be readily apparent to those of ordinary skill in the art upon reading the following detailed description of presently preferred, but nonetheless illustrative, embodiments of the improved portable collapsible baby mattress apparatus when taken in conjunction with the accompanying drawings.

In this respect, before explaining the current embodiments of the improved portable collapsible baby mattress apparatus in detail, it is to be understood that the portable collapsible baby mattress apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved portable collapsible baby mattress apparatus.

It is therefore important that the claims be regarded as including such equivalent constructions insofar as they do not depart from the spirit and scope of the portable collapsible baby mattress apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the portable collapsible baby mattress apparatus generally designated by the reference number 10 will be described.

Figure 1:
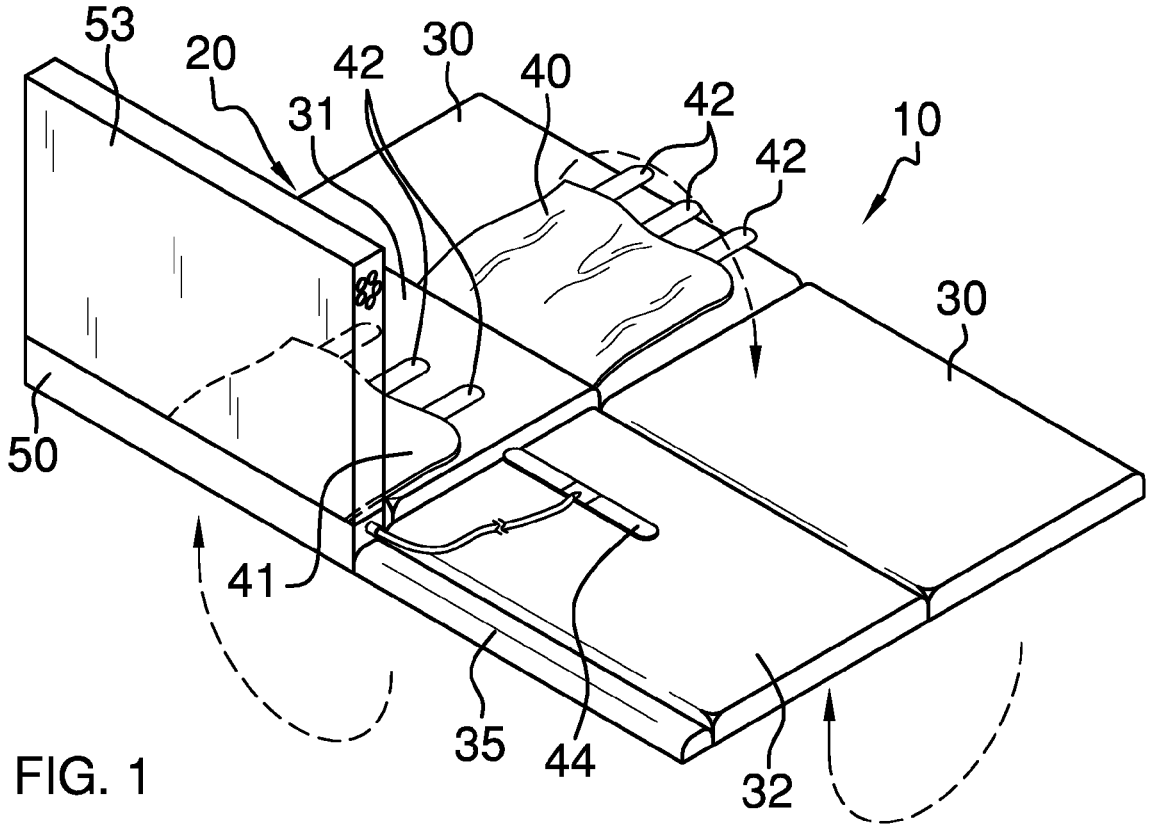
FIG. 1 is a second side perspective view, mattress assembly pads folded out and affixed to each other.

Referring to FIG. 1, the apparatus 10 partially comprises the mattress assembly 20 comprised a pair of larger pads 30 and a pair of smaller pads comprising the first smaller 31 pad and the second smaller pad 32. The larger pads 30 and the smaller pads each have a pad length 33 of about 67.5 cm. The larger pads 30 have a pad width 34 of about 42.5 cm. The smaller pads have a pad width 34 of about 37.5 cm.

Figure 3:
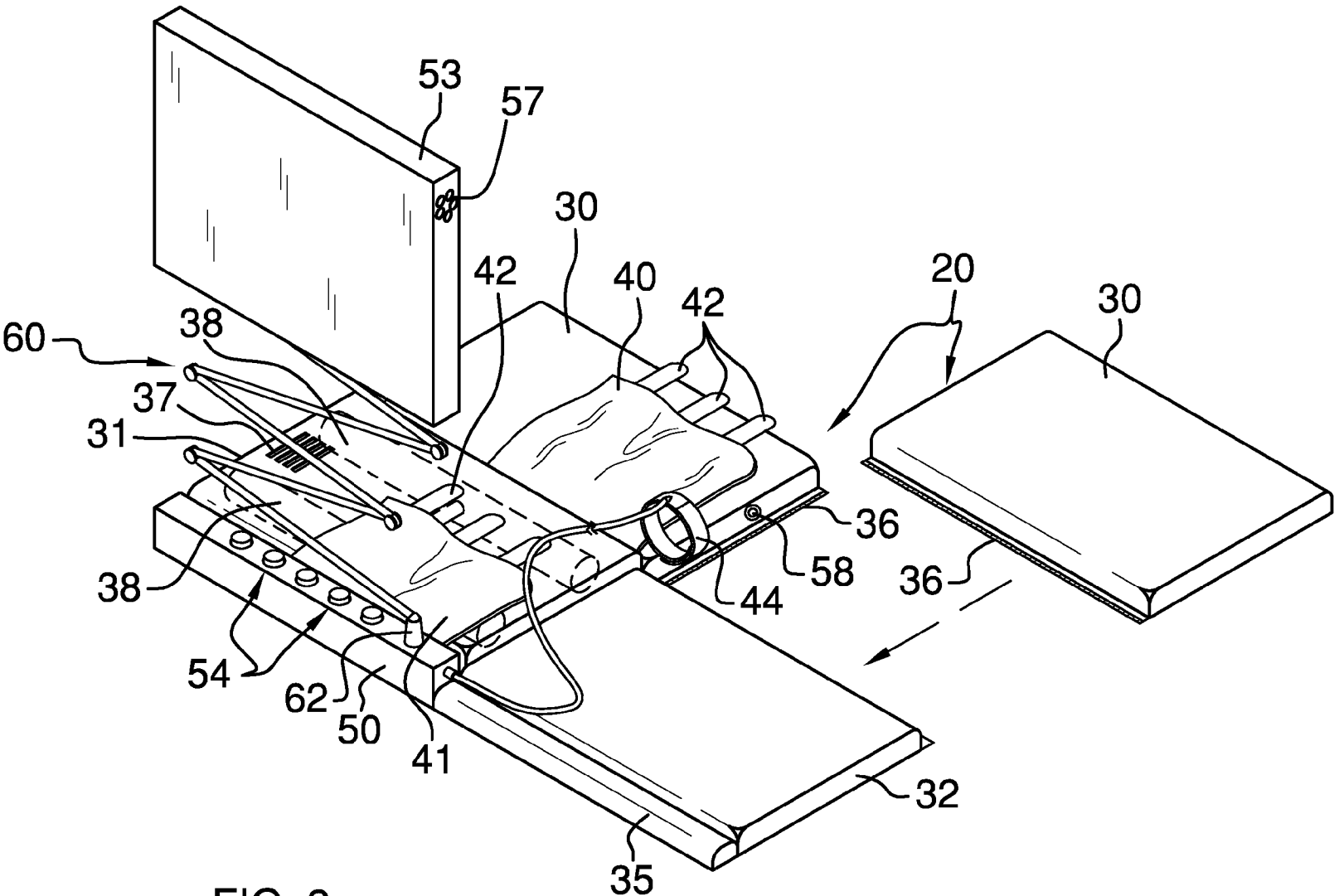
FIG. 3 is a second side perspective view, one pad detached from the other pads, view screen partially elevated via the accordion arms.
Figure 4:
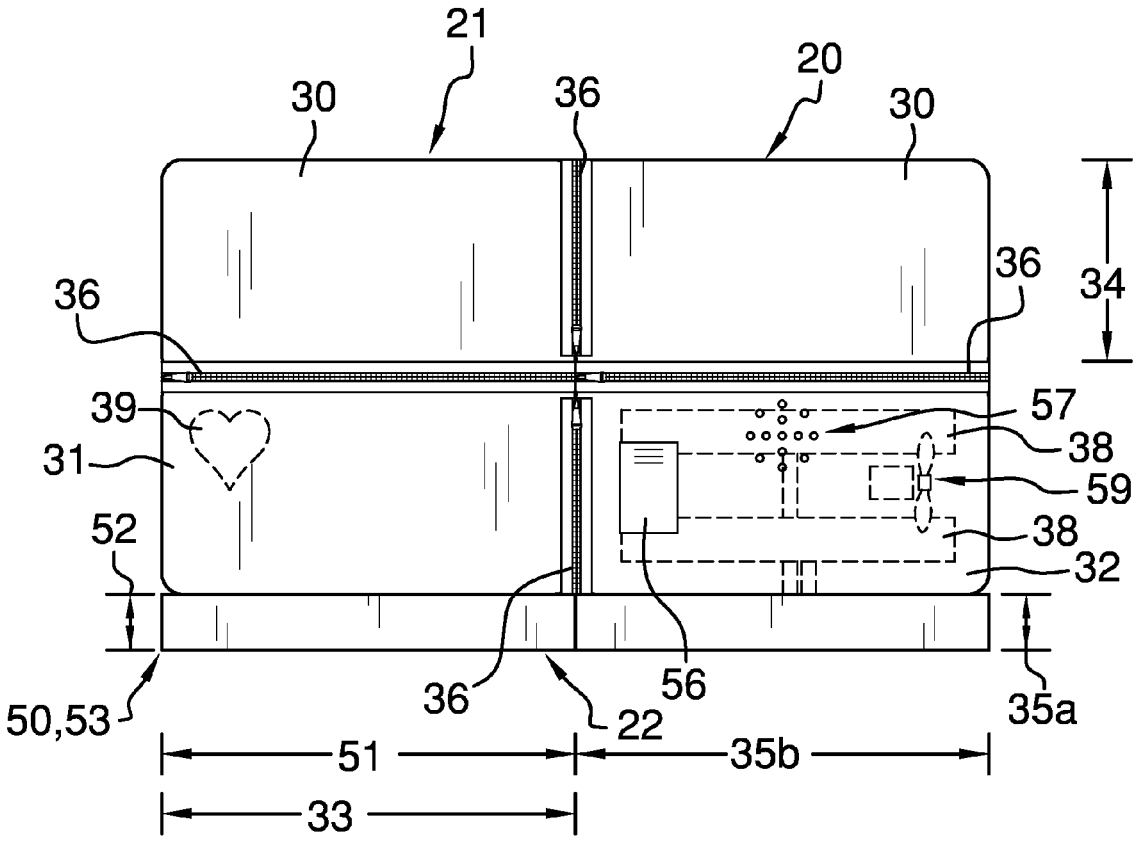
FIG. 4 is a top plan view with mattress assembly pads affixed to each other.
Figure 5:
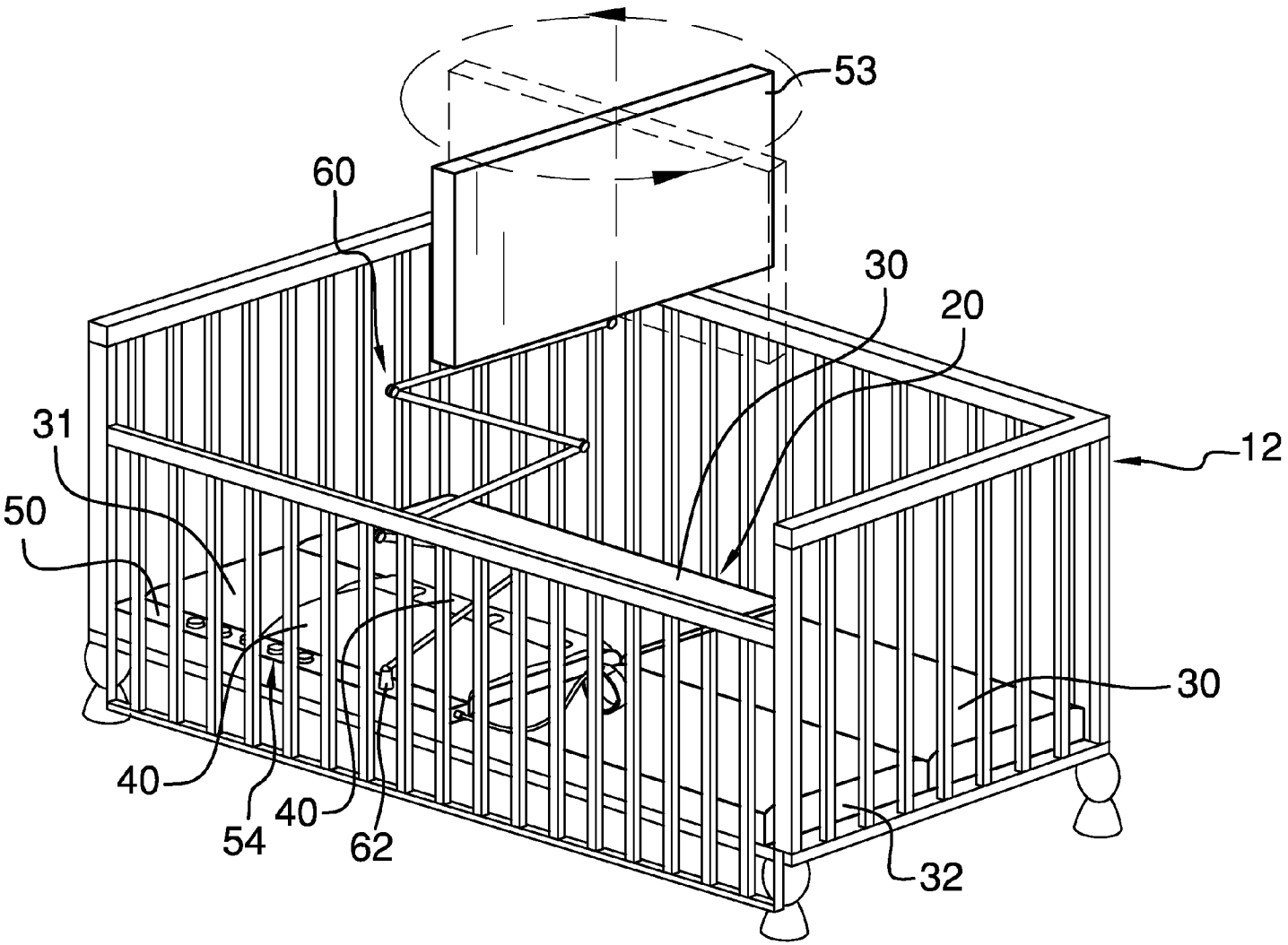
FIG. 5 is a perspective view of the apparatus installed in an existing crib.

Referring to FIGS. 3 and 4, the plurality of pad fasteners 36 selectively joins the pads into a rectangular plane. A plurality of selectively inflatable air tubes 38 is disposed within each pad. The vent with fan 37 is disposed upwardly in the first smaller pad 31. The vital signs nodule 39 is disposed within the first smaller pad 31.

Figure 2:
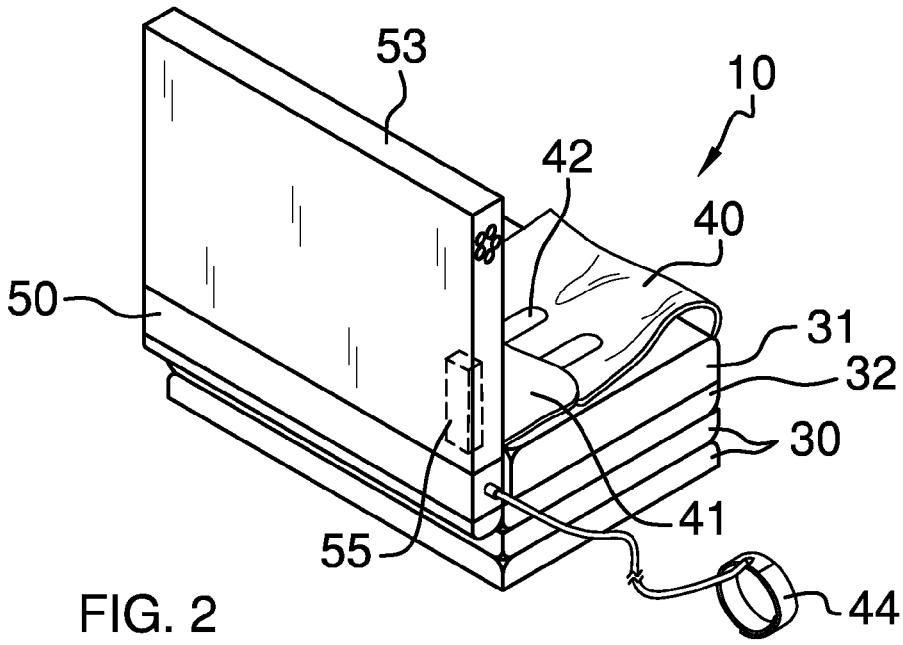
FIG. 2 is a second side perspective view, mattress assembly pads stacked one atop the other, hinged view screen unfolded.

Referring to FIG. 2, the pair of spaced apart blanket sections 40 is removably connected outwardly to the first smaller pad 31. A plurality of spaced apart blanket fasteners 42 is affixed to each blanket section 40 for selectively and adjustably fastening the blanket sections 40 together.

Referring again to FIG. 4, the inflatable rib 35 is disposed along the pad length 33 of the second smaller pad 32. The rib 35 has a rib length 35*b* of about 67.5 cm and a rib width 35*a* of about 5 cm. Importantly, the combined rib width 35*a* and second smaller pad 32 pad width 34 are equal to the larger pads' 30 pad widths 34 of about 42.5 cm. The computer case 50 is disposed along the pad length 33 of the first smaller pad 31. The computer case 50 has a case length 51 of about 67.5 cm and a case width 52 of about 5 cm. Importantly, the combined case width 52 and pad width 34 of the first smaller pad 31 are equal to the pad width 34 of the larger pads 30.

Referring again to FIG. 3, the view screen 53 is disposed atop the computer case 50. The alarm 55 is disposed within the view screen 53. The speaker/mic 57 is disposed within the view screen 53. The strap monitor 44 is connected to the computer case 50 and selectively monitors the vital signs of an infant. The swivel 62 with upwardly disposed frictionally engaged accordion arms 60 connects the view screen 53 to the computer case 50.

Referring again to FIGS. 3 and 4, the inflation fan 59 is disposed within the second smaller pad 32. The inflation fan 59 is in selective communication with the inflatable rib 35 and the air tubes 38 via connections 58. The battery pack 56 is disposed within the second smaller pad 32.

Referring to FIG. 5 and again to FIG. 3, the controls 54 are disposed upwardly within the computer case 50, the controls in communication with the inflation fan 59, the battery pack 56, the alarm 55, the view screen 53, the speaker/mic 57, the vital signs nodule 39, the vent with fan 37, and the strap monitor 44. The apparatus 10 is positioned within the typical crib 12. The view screen 53 is disposed upwardly and swiveled to provide best viewing for a baby.

With respect to the above description then, it is to be realized that the optimum dimensional relationships for the parts of the portable collapsible baby mattress apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the portable collapsible baby mattress apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the portable collapsible baby mattress apparatus may be used.

Therefore, the foregoing is considered as illustrative only of the principles of the portable collapsible baby mattress apparatus. Further, since numerous modifications and changes will readily occur to those skilled in the art, it is not desired to limit the portable collapsible baby mattress apparatus to the exact construction and operation shown and described, and accordingly, all suitable modifications and equivalents may be resorted to, falling within the scope of the portable collapsible baby mattress apparatus.

What is claimed is:

1. A portable collapsible baby mattress apparatus comprising, in combination:

a mattress assembly comprising a quartet of selectively joined inflatable pads;

an inflation fan disposed within one of the pads, the inflation fan in selective communication with the inflatable pads;

a computer case disposed laterally along one of the pads;

a view screen disposed atop the computer case;

a swivel with upwardly disposed frictionally engaged accordion arms connecting the view screen to the computer case;

a battery pack disposed within one of the pads;

a controls disposed upwardly within the computer case, the controls in communication with the inflation fan, the battery pack, and the view screen.

2. The apparatus according to claim 1 wherein the view screen further comprises a speaker/mic, the speaker/mic in communication with the controls.

3. The apparatus according to claim 2 further comprising a strap monitor connected to the computer case, the strap monitor selectively monitoring a pulse of an infant.

4. The apparatus according to claim 3 further comprising an alarm, the alarm in communication with the controls, whereby a pulse rate outside of a setting of the controls triggers the alarm.

5. The apparatus according to claim 1 further comprising a strap monitor connected to the computer case, the strap monitor selectively monitoring a pulse of an infant.

6. The apparatus according to claim 5 further comprising an alarm, the alarm in communication with the controls, whereby a pulse rate outside of a setting of the controls triggers the alarm.

7. A portable collapsible baby mattress apparatus comprising, in combination:

a mattress assembly comprised a pair of larger pads and a pair of smaller pads comprising a first smaller pad and a second smaller pad;

a plurality of pad fasteners selectively joining the pads into a rectangular plane;

a plurality of selectively inflatable air tubes disposed within each pad;

an inflatable rib disposed along the pad length of the second smaller pad;

a computer case disposed along the pad length of the first smaller pad;

a view screen disposed atop the computer case;

an alarm disposed within the view screen;

a speaker/mic disposed within the view screen;

a swivel with upwardly disposed frictionally engaged accordion arms connecting the view screen to the computer case;

an inflation fan disposed within the second smaller pad, the inflation fan in selective communication with the inflatable rib and the air tubes;

a battery pack disposed within the second smaller pad;

a controls disposed upwardly within the computer case, the controls in communication with the inflation fan, the battery pack, the alarm, the view screen, and the speaker/mic.

8. The apparatus according to claim 7 wherein one of the pads further comprises a vent with fan disposed upwardly in one of the pads, the controls further in communication with the vent with fan.

9. The apparatus according to claim 8 wherein one pad further comprises a vital signs nodule disposed within the first smaller pad, the vital signs nodule in communication with the controls.

10. The apparatus according to claim 7 wherein one pad further comprises a vital signs nodule disposed within the first smaller pad, the vital signs nodule in communication with the controls.

11. A portable collapsible baby mattress apparatus comprising, in combination:

a mattress assembly comprised a pair of larger pads and a pair of smaller pads comprising a first smaller pad and a second smaller pad, the larger pads and the smaller pads each having a pad length of about 67.5 cm, the larger pads having a pad width of about 42.5 cm, the smaller pads having a pad width of about 37.5 cm;

a plurality of pad fasteners selectively joining the pads into a rectangular plane;

a plurality of selectively inflatable air tubes disposed within each pad;

a vent with fan disposed upwardly in the first smaller pad;

a vital signs nodule disposed within the first smaller pad;

a pair of spaced apart blanket sections connected outwardly to the first smaller pad;

a plurality of spaced apart blanket fasteners affixed to each blanket section;

an inflatable rib disposed along the pad length of the second smaller pad, the rib having a rib length of about 67.5 cm and a rib width of about 5 cm;

a computer case disposed along the pad length of the first smaller pad, the computer case having a case length of about 67.5 cm and a case width of about 5 cm;

a view screen removably disposed atop the computer case;

an alarm disposed within the view screen;

a speaker/mic disposed within the view screen;

a strap monitor connected to the computer case;

a swivel with upwardly disposed frictionally engaged accordion arms connecting the view screen to the computer case;

an inflation fan disposed within the second smaller pad, the inflation fan in selective communication with the inflatable rib and the air tubes;

a battery pack disposed within the second smaller pad;

a controls disposed upwardly within the computer case, the controls in communication with the inflation fan, the battery pack, the alarm, the view screen, the speaker/mic, the vital signs nodule, the vent with fan, and the strap monitor.

* * * * *